US005239902A

United States Patent [19]

Kaule

[11] Patent Number: 5,239,902

[45] Date of Patent: Aug. 31, 1993

[54] METHOD AND APPARATUS FOR PROCESSING SHEETS OF MATERIAL IN REGISTER, IN PARTICULAR FOR MAKING SECURITY THREADS

[75] Inventor: Wittich Kaule, Emmering, Fed. Rep. of Germany

[73] Assignee: GAO Gesellschaft fur Automation und Organisation, Fed. Rep. of Germany

[21] Appl. No.: 472,371

[22] Filed: Feb. 1, 1990

[30] Foreign Application Priority Data

Feb. 1, 1989 [DE] Fed. Rep. of Germany ..... 3902960

[51] Int. Cl.[5] ..... B65H 23/038

[52] U.S. Cl. ..... 83/13; 83/74; 83/732

[58] Field of Search ..... 83/13, 74, 732, 425.2; 364/474.09

[56] References Cited

U.S. PATENT DOCUMENTS

| | | | |
|---|---|---|---|
| 4,093,007 | 6/1978 | Hellström | 144/356 |
| 4,633,747 | 1/1987 | Primich | 83/732 |
| 4,694,181 | 9/1987 | Piller | 250/548 |
| 4,819,528 | 4/1989 | Chadwick | 83/13 |
| 4,892,336 | 1/1990 | Kaule et al. | 283/91 |
| 4,955,265 | 9/1990 | Nakagawa et al. | 83/74 |

FOREIGN PATENT DOCUMENTS

| | | |
|---|---|---|
| 0110670 | 6/1984 | European Pat. Off. . |
| 0238043 | 9/1987 | European Pat. Off. . |
| 1446851 | 11/1968 | Fed. Rep. of Germany . |
| 2146492 | 3/1973 | Fed. Rep. of Germany . |
| 1095286 | 12/1967 | United Kingdom . |

*Primary Examiner*—Frank T. Yost
*Assistant Examiner*—Kenneth E. Peterson
*Attorney, Agent, or Firm*—Robert J. Koch

[57] ABSTRACT

The invention relates to a method, an apparatus and sheets of materials for producing marked security threads as are used to increase the protection of documents and parers of value against forgery. The inventive method is for processing, in particular cutting, security threads out of sheets of material in register, the sheets of material being fed to the processing units in exact alignment. The feed principal is based on guiding the sheet of material on at least one edge of the sheet, determining the position relative to one of the edges of the sheet, producing a signal form the determination of position, and positioning the feeding device relative to the processing unit so that the sheet of material runs into the latter in a predetermined position.

14 Claims, 3 Drawing Sheets

METHOD AND APPARATUS FOR PROCESSING SHEETS OF MATERIAL IN REGISTER, IN PARTICULAR FOR MAKING SECURITY THREADS

BACKGROUND OF THE INVENTION

1. Field of the Invention

The present invention relates to a method for processing sheets of material in register, in particular for making security elements, to an apparatus for carrying out this method, and to sheets of material that fan be used as a semifinished product for making security threads.

In order to protect bank notes, papers of value, identify cards, etc., better against forgery, it is known to equip these documents with destruct threads, in addition to other security features. In the cash of paper products the security threads are introduced into the furnish layer as it is forming during paper production, while in the case of multilayer plastic products they are embedded between two or more individual layers The security threads are provided with, among other things, printing extending in the longitudinal direction of the tread, whereby such known printing may be present in the form of patterns or alphanumeric characters, optically effective structures and/or readily visual and/or only machine readable prints, additives or coating. The printing extends in a constant form over the entire length of the thread, whereby a pattern or writing is repeated any number of times. In the following test, a term such as "printed pattern," "printing," etc., stands for any kind of marking; it also includes embossing punching, coatings, etc.

2. Description of the Related Technology

For reasons of manufacturing technology, printed security threads re produced from wide sheets of film. The sheets of film are first printed with patterns or writing in a parallel arrangement; these sheets of film are then cut into the individual security threads. Since the threads generally have a width of only 0.5–1.5 mm, great effort is usually required to cut the fill in register with the printing. One has therefore in many cases preferred to elect the individual lines of working and the width of the threads in such a way that at least one line of writing is always found completely on the thread after it is cut (DE-OS 124 46 851).

Another known method consists in printing the desired pattern on transparent films with large spaced between the prints and then performing the cut in the spaces. After the security thread is embedded in the paper the transparent area is not recognizable; one can only see the printed pattern running the longitudinal direction of the thread. This method involves the consequence that the thread to be embedded must be considerably wider than the visible thread portion. The embedding of a wide thread has an adverse affect on the quality of the document and security paper, reducing the tearing strength of the paper and the adherence of the thread in the paper. Furthermore, threads exceeding a certain width can no longer be embedded in the paper with the necessary reliability of manufacture, i.e. without forming holes.

A method that voids the oven problems and allows sheets of film to be processed in register is known, for example, form EP-A 0 238 043. In this known method, security threads, or the sheets of film bearing the security threads, are equipped with a mechanically detachable longitudinal surface structure. Using profiled rollers or similar devices which engage these structures, one can thus feed the sheets of film to further processing devices, such as printing devices or cutting devices, in exact alignment with these structures. However, this solution can only be used for sheets of film having a suitable surface structure, or requires an additional method step to apply the surfaces structure.

Other methods known from general printing technology are to guide sheets of material by means of printed markings. When the sheets of material run into the processing unit, e.g. a cutting unit, the positional deviations of the marking from desired positions are picked up by sensors. A control signal formed therefrom is fed to a register control means which then performs a correction of position (DE-AS 21 46 492). However, this marking-controlled positioning of the sheet involves substantial disadvantages.

Thus, it is necessary to dispose the sensor as close as possible to the actual place of processing in order to void sources of error, in particular to prevent the sheets of material from running out between the sensor and the cutting position. Furthermore, the sensor and the processing units must be in a fixed spatial relation to each other, which necessitates an additional stable mechanical connection between the mechanic and the sensor.

These requirements—a fixed structure and adjacent positioning of the sensor to the processing—lead to many kinds of problems. In many cases the available space does not allow the sensor to be disposed in the immediate vicinity of the place of processing. When this is in fact possible, it causes problems for servicing and adjustment work since the sensors are poorly accessible. Furthermore, the immediate vicinity of the sensitive sensors to the processing device increases the range of their being soiled and damaged. Also, the required space makes it difficult to retrofit existing cutting machines with a sheet positioning means.

A further serious disadvantage is that the task of precisely supplying the sheet of material can often be fulfilled with sufficient reliability by the known method only under special operating conditions.

A known arrangement for controlling deviations from a desired position comprises a feeding device (register control means, etc.) and a sensor head which are passed in this order by a sheet of material provided with control markings (DE-AS 21 46 692). The cutting unit is located optionally before or behind the sensor head. The sensor head continuously detects the deviations o the sheet markings from a desired position, forms a control signal and passes it to the feeding device. The feeding device uses the control signal to correct the position of the sheet of material relative to eh cutting unit. The disadvantage o this arrangement is that one obtains different control characteristics depending on the momentarily existing parameters of the arrangement z(control speed, sensor sensitivity, sheet speed, etc.). if the system damping is too low or, equivalently, if the register control means overreacts, the deviation control means passes into a permanently oscillating state. If the system damping si too high, the time constant o the deviation control is not large enough so that errors are corrected too late. This control means requires precisely fixed parameters nd works in the desired manner only within a narrow parameters range. However, the narrower the tolerance limits, the more effort is required for regulation, production methods and production control. At warrantable effort, the attainable cutting tolerances are several tenths of a millimeter.

In the interests of high protection against forgery and reliable embedding in the paper, it is desirable to have narrow, e.g. millimeter-wide, security threads with predefined placement o the marking with respect to the geometry of the thread. The necessary thread dimensions result in a maximum cutting tolerance of 0.1 millimeters. Zone must take account of the fact that the paper is produced in long sheets and the security threads must accordingly also be made available in long threads. This means that the processing memos must guarantee that arrow tolerance limits are met over a long cutting length.

If security threads are cut with a width in the submillimeter range using the known control techniques which correct deviations from the desired position in extremely different ways depending on the existing method parameters, great control effort is required for meeting the tolerances. Large deviations cannot be permitted for the above reasons.

The known control techniques are thus inapplicable, or insufficiently applicable, for making security threads with a printed pattern located exactly over the width of the thread.

SUMMARY OF THE INVENTION

The present invention is based on the problem of providing a method and an apparatus for making security threads having printing extending in the longitudinal direction, whereby this marking must be exactly aligned with the geometry of the thread while narrow tolerances an high quality are met. Furthermore, spatially flexible possibilities of design should make the apparatus resulting from this method easy to integrate into existing processing or manufacturing devices.

This problem is solved by utilizing a sheet processing apparatus and method according to the invention. An apparatus for producing and processing security threads is an object of the invention. A sheet of material as can be used as a semifinished product for making an processing security threads is also an object of the invention.

The particular advantage of the invention is that a method is used that allows for position control in the technical sense. That is, in accordance with a determined position of the printing relative to the edge of the sheet the feeding device is given a control signal, the common reference line being the edge of the sheet. Such position control means are free from regulating errors, unlike position regulators which an only react to deviations from desired values.

A further advantage of the inventive method is that one is very free in selecting the location of the sensors. The sensor can thus be disposed at basically any distance form the processing until It must merely be ensured that when every point on the sheet of film runs into the unit the corresponding control signal is applied to the feeding device. A constant belt speed, or an exact machine pace, facilitates this task.

This method makes it possible to cut sheets of film on which the security thread printing is disposed many times side by side, in such a way that each thread cut out of this sheet has its printing in the desired position, e.g. in the center.

In a preferred embodiment of the invention, the cutting process is performed in two steps. The two steps of the cutting process are a rough cut and a fine cut. In the first step, the rough cut, several strips of equal width are cut out of the meter-wide sheets of film. Due to their constant width these strips of film can be directed reliabily by the edges in standardized devices of simple design. In the second step, the fine cut, the individual security threads are ten cut out of the strips of film.

The usually transparent films are preferably designed in such a way that a number of copies (the printing of individual security threads) is followed by an area with no such printing. This area is printed with a control line contrasting with the transparent sheet of film. In the rough cut the sheet of film is cut into strips along the this control line, the latter being of a width such that the cutting line always extends within this control line. Since the control line is printed on together with the printing, there is a guarantee that the edges of the control lines extend parallel to the printing.

After the rough cut of the sheet of film one thus obtains strips of film having an interrupted control line on at least one edge of the sheet. Since the edge of the printing and the edge of the control line are parallel, the width of this cut control line is a direct measure of the distance between the printing and the edge of the sheet. To perform the fine cut by the inventive method, it is thus merely necessary to determine the remaining width of the control line. The resulting measured value can then be used directly to form the control signal for the feeding device. To determine the measured signal one preferably uses optical sensors, for example a lattice of CCD sensors.

The inventive method can e used not only for cutting devices, but also in other processes and way of treating sheets of material, e.g. for applying embossed structures in exact alignment with printing previously applied to a film, for applying printing to be exactly associated with marking already present in on the sheet of material, etc.

Further advantages, advantageous embodiments and developments are the object of the dependent claims and the description with reference to the figures.

DETAILED DESCRIPTION OF THE PREFERRED EMBODIMENT

Figure 1:
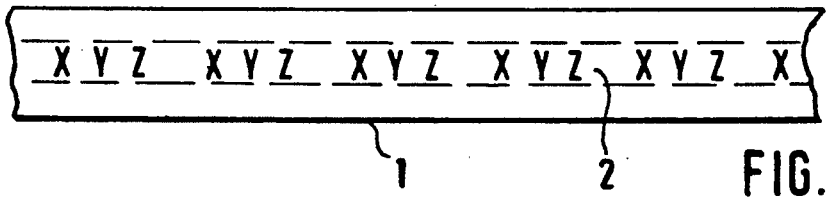
FIG. 1 shows security thread.

FIG. 1 shows a security thread 1 which is better protected against forgery by being provided with printing 2 aligned with the middle of the thread. In the example shown, the printing consists of the letters "XYZ", which are repeated along the length of the thread. The material used for security threads is preferably transparent plastic such as polyester. The width of the threads which are embedded in paper typically ranges from 90.5 to 1.5 mm; threads embedded in plastic may also be wider.

Figure 2:
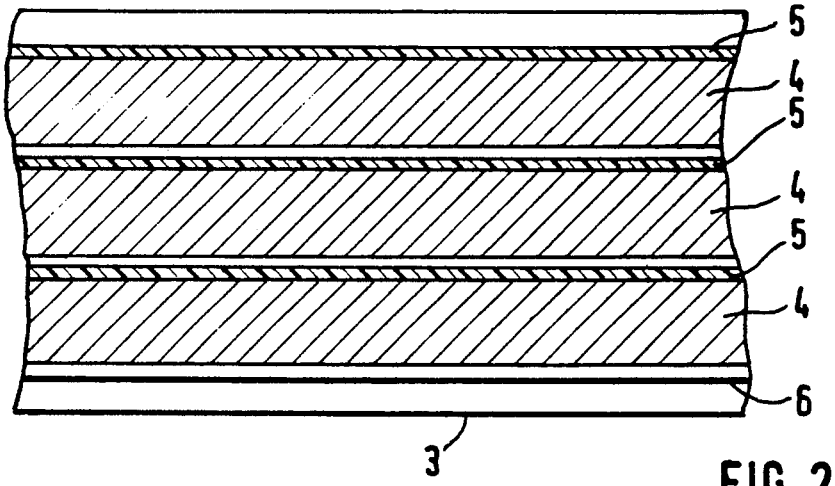
FIG. 2 shows a printed sheet of film as is used as a semifinished product for security threads.
Figure 3:
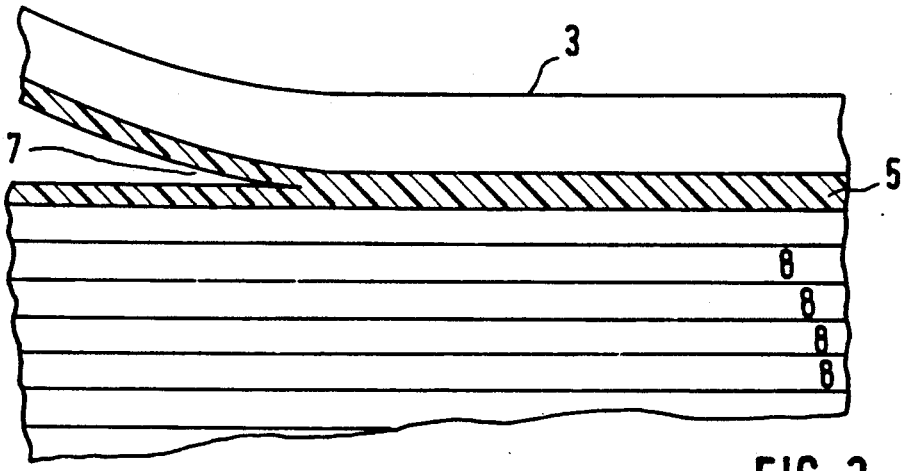
FIG. 3 shows a section of the sheet of film of FIG. 2.

The security threads are produced from sheets of film having a useful width of .5 to 1.5 m. FIG. 2 shows an embodiment of a sheet of film 3 as is used as a semifinished product for making security threads. The printing on the sheet of film consists of packages of copies 4 disposed side by side with control lines 5 adjacent thereto or located therebetween. the packages of copies themselves consist of individual copies one beside the other, the number of copies in such a package being approximately fifty, and each containing the printing for a security thread. The control lines are located n the unprinted area between the packages of copies and extend parallel thereto.

In a first cutting operation, the rough cut, sheet of film 3 is cut into individual strips of film each containing package of copies. The sheet feed is adjusted on the basis of control lines 5 or separate edge lines 6.

In the preferred embodiment shown here, the film is cut by a plurality of parallel cutting knives the cutting knives being disposed in such a way that the cut is performed within these control lines 5.

FIG, 3 shows a section of such a sheet of film 3, with rough cutting line 7 extending within control line 5. control line 5 is directly adjacent to printing 8 of the individual security threads.

The width of the control lines is selected so as to ensure that the rough cutting line extends within the control line along the entire length of the sheet, even when all cutting tolerances are met. Due to the parallel arrangement of the knives, the sheets of film are also cut constantly in a predetermined width along the entire length of the sheet.

Figure 4:
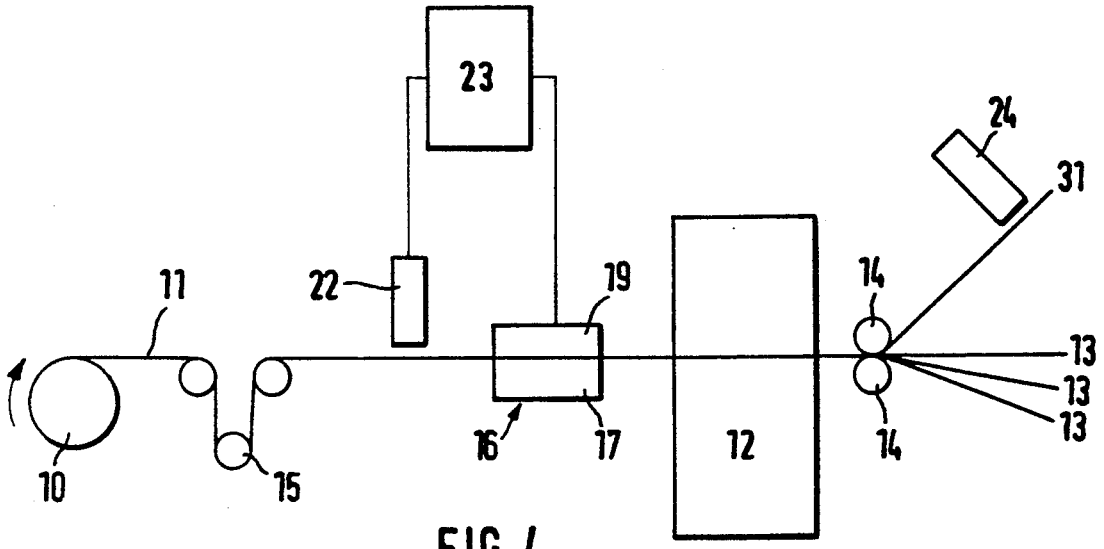
FIG. 4 shows an inventive apparatus or cutting strips of film in a side view.
Figure 5:
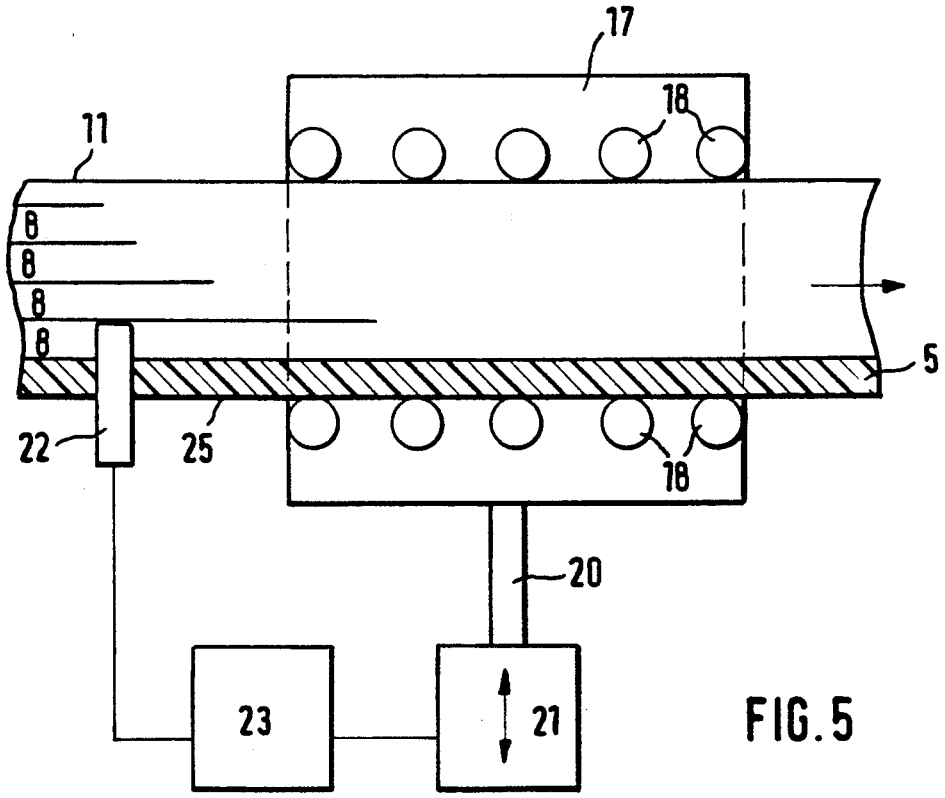
FIG. 5 shows a feeding device with are measurement control circuit for feeding strips of film.

These strips of file are cut into the individual security threads in a fine cutting operation in an apparatus shown schematically in FIGS. 4 and 5. The strip of film wound onto temporary storage rollers 10 during the rough cut are removed form these storage rolls in this apparatus and fed with the air of a transport device to the processing unit, in this case a cutting unit 12. This cutting unit 12 is equipped with a cutter block not shown in the figures, which consists of a plurality of disk like involves disposed on a common axle. The number of knives is coordinated with the number of individual copies on the strip of film; the distance depends on the desired width of the security thread. When the strip of film runs through this cutting mechanism 12 this film is thus cut into a number so security threads 13 which, after they have passed rollers 134, are separated from each other and wound onto individual spools, which are also not shown. The transport system comprises a compensating unit 15 for keeping the strip speed constant at the predetermined value.

The cutting means is preceded by a feeding device 16 for introducing strip 11 into cutting mechanism 12, in particular the cutter block, in a predetermined position relative thereto. In a simple case, this feeding device consists of a base plate 17 with two rows of guide pins 18 parallel to the running direction of the strip; the distance between the rows is coordinated with the strip width so that the strip is guided by edge contact on both sides. The feeding device is covered by an upper cover 19.

Spacing members which are somewhat higher than the strip thickness and located between base plate 17 and cover 10 sensor an unobstructed run of the strip through the feeding device. The device is altogether displaceable laterally to the running direction o the strip, e.g. via a spindle drive 20. The displacement is controlled via an actuator 21, for example a step motor. This lateral displacement of the feeding device allows the strip to be introduced into the subsequent processing means in a predetermined geometrical association therewith.

The particular position of fedding device 16 is determined via a measuring and control circuit. For this purpose the feeding device is preceded by a measuring mechanism 22 which is disposed in the area of cut control line 5 and used for measuring with width of this control line. The measuring mechanism used may be e.g. a CCD element in conjunction with corresponding electronic circuits 23 which produce a control signal for positioning on the basis of the measurement result.

The width of this cut control lien 5 is a direct measure of the distance between the printing of the individual security threads and edge 25 of the strip. If one measures the width of this control line one can thus calculate precisely in advance the position in which the strip of film must be held with the air of the feeding device when it runs into the processing device, so that the printing of the individual security threads runs in exactly between two knives e.g. in the desired central position.

Measuring mechanism 22 itself may be disposed at virtually any distance from the processing or feeding unit. One must merely ensure, e.g. via a corresponding time correlation, that the control signal determined from the width of the control line detected for a certain strip portion is applied to the feeding device at the movement when the strip portion is applied to the feeding device at the moment when the strip portion in question is running through the feeding device. to void errors here, one uses additional elements, such as a counting mechanism for strip lengths, for controlling and registering the strip run. The time correlation may also be provided by utilizing the machine pace or a constant band speed of the transport means.

The feeding device shown here may also be replaced by similar devices which guide the strip e.g. only on one edge and ensure by corresponding mechanical means that the strip always lies with its leading edge against the feeding device. Furthermore, the reel-cutting machine with cutting rollers in mutually fixed arrangement may be replaced by other processing units, such as embossing machines, printing device ad the like, or applying any patterns along each security thread in exact alignment with the printed pattern. These devices may additionally e followed by the above-described acting means. The supply of the strip to the processing units and to the cutting unit may be controlled via a single feeding device, as described above, whereby this feeding device precedes both units. However, each of the processing units may also be provided with such a feeding device, whereby both feeding devices an the corresponding actuators may make use f the measuring result of a common measuring means.

According to an advantageous development, the inventive apparatus is extended by a further measuring unit 24 permitting a final check. This control mechanism 24 may be e.g. a CCD camera which detects one of the already cut threads and can be used to check the actual position of the printing on the thread substitutionally for all the others. This mechanism can be used to detect e.g. systematic errors which may arise through zero maladjustment of the feeding device relative to the processing mechanism. Such errors cannot be detected by above-described measuring mechanism 22.

Figure 6:
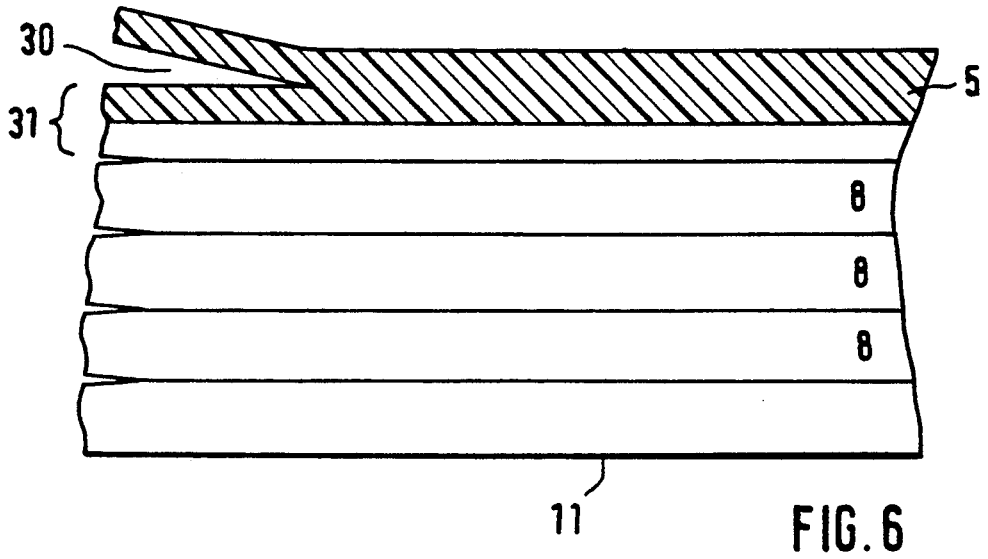
FIG. 6 shows a strip of film with the position of the cutting lines.

In order to create a good precondition for optical sensing for the control mechanism as well, one preferably also performs the fine cut in such a way that at least one of the cutting liens extends within the control line (FIG. 6). When thread 31 containing this pat of the control line is run into control mechanism 24, one can easily detect, with high contrast, the width of the control lines remaining on the thread. If the strip of film was supplied o the processing or cutting mechanism in the correct position, this control line on control thread 31 has a predetermined width, since the control line was printed on the film together with the printing of the individual security threads and this common print ensures that the control line is located at a predetermined distance from this printing. The control mechanism, which may be of similar construction to the measuring mechanism but is disposed behind the processing unit, also of continuous quality control that can be performed with simple measuring technology.

Figure 7:
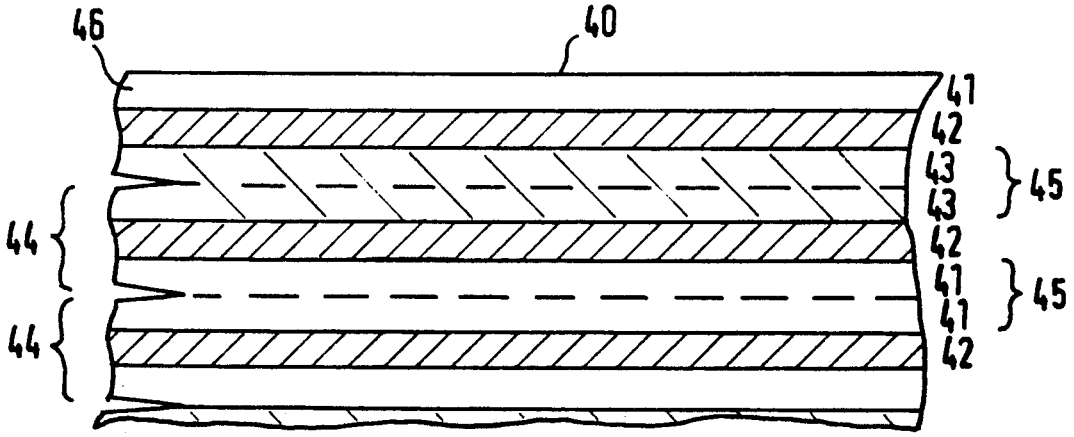
FIG. 7 shows a further embodiment of a strip of film.

In the examples described above, it was always assumed that the feed of the strip of film into the processing mechanism is controlled on the basis of specially provided control lines. However, in may cases the printing of the individual security threads already meets the requirements in terms of design and contract to be able to serve as a control line itself. In the case of security threads having e.g. a pattern of longitudinal stripes, one of the colored stripes can be used directly as a control line. FIG. 7 shows such an embodiment. The security thread is both bear a pattern with three different-colored parallel stripes, e.g. In the national colors black, red and gold. For this purpose, colored stripes 41, 42, 43 are printed on a corresponding film side by side, without spaces therebetween and with the sequence of colors changing from thread to thread. This arrangement leads to colored stripes 45 with double width at regular intervals. If the film is printed over its entire width with these striped patterns in close succession, the rough cut in the first cutting operation can be performed in each one of these double colored stripe 45, and the remaining stripe width 46 from strip of film 40 can be used by the above-described method for adjusting these trip of film for the fine cutting unit. In the fine cutting unit a knife then runs into each of these double colored stripes, so that one obtains security threads having three longitudinal colored stripes of identical dimensions.

this arrangement of the colored strips also has the advantage that one need not cut exactly between two directly adjacent colored stripes. In this case tiny deviations would cause the security thread to have undesirable colored edges which are generally quite visible. The above described colored stripe arrangement makes it possible to print the sheets of film with the various colored strips directly adjacent to each other without any spaces being necessary therebetween to compensate cutting tolerances.

The illustrated embodiments are shown by way of example. The spirit and scope of the invention is not to be restricted by the preferred embodiment shown.

I claim:

1. A method for processing sheets of material in register for makings security elements provided with markings, to be embedded in security documents, wherein a sheet of material bears a plurality of markings, comprising the steps of:

guiding the sheet of material in a transport direction on at least one edge of the sheet, via a feeding device that is laterally displaceable relative to the transport direction;

determining the position of a marking on the sheet relative to an edge of the sheet;

producing signal from this determination of position;

adjusting the feeding device of the basis of the signal in such a way that the guided sheet of material runs into a processing unit with the marking in a predetermined position relative to the processing unit;

cutting the sheet of material in the processing unit into individual thrash or strips with each thread bearing one of the markings; wherein said step of cutting comprises at least a first step of cutting strips of material of constant width out of the sheet of material, and a second step of cutting one or more individual threads out of the strips.

2. The method of claim 1, wherein the sheet of material is a sheet of film.

3. The method of claim 1, further comprising the step of:

placing control lines parallel to the markings on the sheets or strips of material.

4. The method of claim 3, wherein the step of placing control lines includes printing the control lines on the sheets or strips of material.

5. The method of claim 4, wherein each of the control lines exhibits a width, said first step of cutting is performed within the width of a control line, the width of the control line being such that a cutting line extends within the control line over an entire length the sheet of material within cutting tolerances.

6. The method of claim 5, further comprising the step of using a residual width of the control lines on the strips of material to determine the position o the marking relative to a strip edge, and the feeding device is adjusted on the basis of a control signal in such a way that the sheet of material runs into a cutting unit in a predetermined position relative thereto.

7. A method for processing sheets of material in register for making security elements comprising the steps of:

proving the sheets with at least one marking;

determining a width of a control line, wherein the width is defined as the distance between the marking on the sheet and an edge of the sheet;

producing a signal form this determination of width;

guiding the sheet of material in a transport direction on at least one edge of the sheet, via a feeding device that is laterally displaceable relative to the transport direction;

adjusting the feeding device on the base of the signal in such a way that the guided sheet of material runs into a process unit with the marking in a predetermined position relative to the processing unit.

8. The method of claim 7, wherein the sheet of material bears a plurality of markings, further comprising the step of:

cutting the sheet of material in the processing unit into individual threads or steps with each thread bearing one of the markings.

9. The method of claim 8, wherein the step of cutting the sheet of material further comprises:

a first step of cutting strips of material of constant width out of the sheet of material;

a second step of cutting one or more individual threads out of the strips.

10. The method of claim 9, further comprising the step of placing control lines parallel to the markings on the sheets or strips of material.

11. The method of claim 10, wherein the step of placing control lines includes printing the control lines on the sheets or strips of material.

12. The method of claim 10, wherein each of the control liens exhibits a width, said first step of cutting is performed within the width of a control line, the width of the control line being such that a cutting line extends within the control line over an entire length of the sheet of material within cutting tolerances.

13. The method of claim 12, further comprising the steps of:

using a residual width of the control lines on the strips of material to determine the position of the marking relative to a strip edge;

adjusting the feeding device on the basis of a control signal in such a way that the sheet of material runs into a cutting unit in a predetermined position relative to the cutting unit.

14. The method of claim 7, wherein the sheet of material is a sheet of film.

* * * * *